US005661946A

United States Patent [19]

Davis

[11] Patent Number: 5,661,946

[45] Date of Patent: Sep. 2, 1997

[54] POLE TOP EXTENSION

[76] Inventor: Kenneth Davis, 3224 Lake Albano Cir., San Jose, Calif. 95135

[21] Appl. No.: 628,099

[22] Filed: Apr. 9, 1996

[51] Int. Cl.[6] ..... E04C 3/30

[52] U.S. Cl. ..... 52/736.1; 248/219.2; 248/230.3; 403/312

[58] Field of Search ..... 52/736.1, 726.1; 248/218.4, 219.2, 230.3, 534, 539; 403/286, 300, 301, 310, 312; 116/173; 114/90

[56] References Cited

U.S. PATENT DOCUMENTS

| | | | |
|---|---|---|---|
| 1,420,430 | 6/1922 | Jaeckle et al. . | |
| 3,201,834 | 8/1965 | Baittinger | 20/92 |
| 3,802,206 | 4/1974 | Moore et al. | 61/53 |
| 3,817,394 | 6/1974 | Saiki | 248/218.4 X |
| 3,921,949 | 11/1975 | Coon | 248/219.2 |
| 4,032,244 | 6/1977 | Quayle | 403/286 |
| 4,048,779 | 9/1977 | Valenziano et al. | 52/726 |
| 4,092,079 | 5/1978 | Swanson | 403/306 |
| 4,097,165 | 6/1978 | Quayle | 403/286 |
| 4,577,449 | 3/1986 | Celli | 248/218.4 X |
| 4,689,889 | 9/1987 | Reeves | 248/539 X |
| 5,222,344 | 6/1993 | Johnson | 52/728 |
| 5,230,176 | 7/1993 | Schomaker | 248/218.4 X |
| 5,360,191 | 11/1994 | Carson et al. | 248/218.4 |
| 5,444,951 | 8/1995 | Scott et al. | 248/219.2 X |

OTHER PUBLICATIONS

"Pole Top Extension for Wood Poles," Department of Engineering, Pacific Gas and Electric Company: San Francisco, CA, 2 pages (Sep. 8, 1952).

"Highline Case History: Fiberglass Utility Poletop Extensions," Highline Products Corporation: Old Saybrook, CT, 8 pages.

*Primary Examiner*—Carl D. Friedman
*Assistant Examiner*—Beth A. Aubrey
*Attorney, Agent, or Firm*—Flehr Hohbach Test Albritton & Herbert LLP

[57] ABSTRACT

A pole top extension assembly (10) for mounting a wooden extension bayonet (37) having a rectangular cross section to the flattened top of a cylindrical wooden utility pole (21). The pole top extension assembly (10) comprising a pair of bracket members (25 and 27) each having leg portions (30) extending downwardly from the top of he wooden utility pole (21), and each bracket member further having a matingly interengageable portion (29 and 31) which couples the said bracket members together over the top of pole (21). At least one of said bracket members including a rectangular collar (35) opening upwardly to receive a bayonet member therein, with said rectangular collar having two pairs of opposite side walls (41and 43) oriented, respectively, substantially parallel and perpendicular to said leg portions (30).

8 Claims, 6 Drawing Sheets

POLE TOP EXTENSION

TECHNICAL FIELD

In general, the present invention relates to pole top extensions for wooden utility poles and, more particularly, this invention relates to an apparatus for connecting a pole extension bayonet or supplemental length of pole to the top of a wooden utility pole.

BACKGROUND ART

1. Pole Top Extension Bayonets

In the utility industry, pole top extensions or bayonets are frequently used to add length to the top end of wooden utility poles. Pole top extensions are typically used to increase the height of a wooden utility pole, for example, for mounting existing wires at a greater height above ground level when wire or cable requirements change. The pole top extension eliminates the need to resort to replacing or changing out the entire wooden utility pole.

Many states have code requirement which mandate that electrical lines must be positioned above television cables. Rather than incur the costs of burying the TV cable or duplicating the poles used, therefore, it is often desirable to mount television cables to existing utility poles. Ground clearance problems usually will not permit simply mounting a television cable below the electrical lines.

Accordingly, the choice will be between adding a pole top extension to the existing poles and raising the electrical lines, or changing out the existing poles for taller poles which can support both lines.

Changing out poles is an expensive procedure since it usually must be done without interrupting existing service. Moreover, changing out poles is environmentally undesirable in that it results in the use of new pole timbers in substantial numbers.

Moreover, as new utility lines are added to utility poles for any reason, at some point the existing cross-arms cannot be used to support the lines and new vertically spaced cross-arms are required. Moreover, with additional line often comes auxiliary equipment, and particularly heavy transformers. Thus, utility pole extensions can be used for the additional lines, but most pole top extension bayonets are not rated for transformers and other heavy equipment.

Finally, utility lines can be reconfigured to provide corner runs, where the direction of line travel changes (typically by 90°), causing transverse stresses tending to topple the pole. Guying frequently required at corner runs and some pole top extensions are not rated for guying. Thus, one of the important considerations when deciding whether or not to add a pole top extension or change-out a pole has been whether or not guying is required or transformers must be installed on the extension. While pole top extensions for utility poles have been in use for many years, many are not rated for support of anything other than a cross-arm and wires. Thus, in line reconfigurations requiring guying or heavy equipment support, the only acceptable approach often has been to change out the poles.

2. Specific Prior Art Systems

While the desirability of using pole top extensions has been around for many years, the solutions have not been very satisfactory. The patent literature contains various approaches which have not gained wide-spread use. For example, U.S. Pat. No. 1,420,430 to Jaeckle and Mehlhorn discloses a means for securing the sections of a mast or pole together. Specifically, this is done by using a plurality of curved plates which are placed symmetrically around the pole and are bolted to the pole. These plates are secured so as to overlap the abutting ends of the two sections of the mast or pole to be held together. Owing to the elasticity to the plates, they may be employed to connect poles of somewhat different diameters; however, this apparatus is not typically suitable as a pole top extension due to the often large difference in diameters between the existing pole and the extension bayonet. Furthermore, Jaeckle and Mehlhorn's device is designed to connect two circular cross-section pole lengths together, and could not easily join a circular cross-section pole to a rectangular cross-section extension bayonet.

U.S. Pat. No. 3,201,834 to Baittinger and U.S. Pat. No. 3,802,206 to Moore, et al. disclose pile splicers for joining lengths of timber piles. These devices are not designed as pole top extension bayonet connectors. Furthermore, these devices are not well suited to join two piles of differing cross-section.

U.S. Pat. No. 4,032,244 to Quayle discloses a pole top extension bracket for a wooden utility pole. A bracket is mounted between the flattened top of a utility pole and the bottom end of an extension bayonet. A center shaft extends from this bracket to be received within a central bore provided in the utility pole, the extension pole or both. A number of threaded fasteners and straps run longitudinally across the connection between the pole and extension bayonet, and are bolted onto the exterior of both. These fasteners and metal straps are evenly spaced at four locations around the circumference of the poles. U.S. Pat. No. 4,097,165 to Quayle represents a slightly altered form of this design. The design of both of these Quayle devices could only be used to connect two poles of circular cross-section, and not one of circular cross-section to one of rectangular cross-section and the Quayle brackets assemblies are complex in the extreme. The time required to install such assemblies on the top of a utility pole would be unacceptable for wide-spread use.

U.S. Pat. No. 4,048,779 to Valenziano, et al. discloses a turn buckle connector which is used in replacing an existing utility pole without disturbing the hardware that is mounted thereon. The free end of the existing utility pole with the hardware mounted thereon is severed from the existing pole. A new pole is placed into the earth with its end then connected to the turn buckle which has a plurality of girdle plates each having side marginal flanges and a terminal flange. The turn buckles connect the side marginal flanges of the adjacent girdle plates to each section to draw them toward them together so that the section is gripped. This turn buckle comprises a plurality of girdle plates having radially projecting flange portions cooperating to form a radially projecting flange. The Valenziano turnbuckle is specifically designed for use in replacing the bottom section of a utility pole, rather than the top section. This obviously has the undesirable requirement that the existing pole bottom be removed from the ground and the further requirement that the extension must be very large in order to withstand the entire weight of the pole. Furthermore, this device is specifically designed to only connect together two poles having circular cross-sections.

U.S. Pat. No. 4,092,079 to Swanson discloses a connector for replacing an existing utility pole without disturbing the hardware mounted thereon. Accordingly, it again is based upon removal of the bottom of the pole, with the above-noted disadvantages. The Swanson connector includes an annular sleeve engageable about the outside of the new pole section. This sleeve projects above the bottom end of the Swanson existing pole section and below the-top end of the new utility pole, forming a socket for receiving both of these ends, with push plates positioned within the sleeve to embrace the top section to hold it socketed therein. These push plates are engaged with the pole sections by means of bolts anchored in the sleeve. This device is not suited for connecting an extension to the circular top end of a wooden utility pole having its cross-arms in place because the cross-arms would interfere with the sleeve.

U.S. Pat. No. 5,222,344 to Johnson discloses a pole for supporting utility lines. In this structure, an interior lattice of composite members forms an elongated open celled beam which is enclosed by a composite outer skin. The interior lattice is made of protruded composites designed to replace steel in some applications where their weight corrosive resistance and insulated properties are useful. The Johnson structure, in one embodiment, shows the exterior skin forming a sleeve over the top of a post thus forming a pole top extension. The Johnson device is not directed at a method or apparatus of connecting an extension to an existing pole, but rather the manufacture or fabrication of a utility pole.

Rather than employing assemblies as set forth in the above patent art, the industry has tended to use one of two approaches, namely, to bolt and band together a pair of extension members to opposite sides of a pole or install a fiberglass extension tube to the top of the pole.

Typical of the bolt-together approach is the assembly of Pacific, Gas & Electric Engineering Standard No. 028691. In this assembly, two rectangular wooden extension members are bolted to the opposite sides of a cylindrical wooden utility pole. A bracket is also lag screwed into the pole and bolted to both of the extensions. Finally, a cross-arm assembly is bolted to the top ends of the extension members.

This bolt-together assembly, however, is very tedious to install, typically requiring one to two hours for two line men on the pole and/or in a hoist to construct the assembly on the pole top. While it is rated for guying, transformers cannot be supported on such pole top extension members. This is due to the fact that the weight of these pole top extensions, and any fixtures attached thereto, is supported fully by only one bolt positioned at a bottom bracket. This bolt passes through the utility pole, and is subjected to heavy shear stresses as a result of the weight of the extension bayonet assembly.

A fiberglass pole top extension of the type in use in the industry for 20 years is shown in the publication entitled "Highline Case History Fiberglass Utility Poletop Extensions" and Tech Data Sheets of Highline Products Corporation of Old Saybrook, Conn.

In this design, a hollow fiberglass extension pole, having a circular cross-section, is mounted onto the top of a metal extension bracket which is attached to the top of a cylindrical utility pole. The fiberglass extension is attached by mounting it slidably over an upwardly protruding bracket collar. Numerous limitations exist with this device. First, the use of hollow fiberglass, as opposed to wood, results in an extension bayonet which is much weaker than a wooden extension. The fiberglass tube is not being able to withstand any significant bending stresses that would be caused, for example, by guying or by mounting a heavy transformer onto the bayonet extension. As such, these fiberglass extension bayonets are typically limited to carrying only cross-arms and attached wires. Secondly, the drilling of holes in the fiberglass bayonet is difficult in the field. Clean drilling of tubular fiberglass extensions can best be accomplished in a factory using carbide drills which are not normally available in the field. Consequently, fiberglass extension bayonets typically are special ordered from a factory for later use in the field. The alignment of field-drilled holes when mounting the bayonet is also difficult. This may cause problems with the proper orientation of components, such as wires and cross-arms mounted onto the bayonet extension. Thirdly, the fiberglass collar used has a height less than its diameter, which is adapted to receive only a single transverse lag bolt therethrough. The resulting structure is thus not very resistant to bending stresses. Lastly, users of the pole top extensions sometimes do not know the relationship between the mounting bracket and the drilled holes. Consequently, this requires additional holes to be drilled into the bracket in order to allow the user to rotate the pole top extension 90° if necessary.

Numerous other problems exist with fastening cross-arms to a cylindrical shaped extension bayonet. There will be only a minimal point contact occurring when a flat sided cross-arm is bolted to this cylindrical shaped face. This problem lowers the stability of the connection. Consequently, under heavy wind loading, cross-arm connections to fiberglass extensions tend to wobble and loosen with time.

Furthermore, tubular extension bayonets are also particularly ill-suited for use as corner run assemblies where the lines change their direction of travel. This is due to the fact that it is difficult to attach two perpendicular cross-arms at about the same height on the sides of the bayonet. The use of two perpendicular cross-arms is a common assembly for corner run poles where the lines change their direction of travel. Typically, at these corner end runs, a second cross-arm is mounted lower than, and perpendicular to, a first cross-arm. The lines are simply dropped down from the ends of the first cross-arm to the ends of the second cross-arm and then proceed away in a direction of travel perpendicular to that from which they arrived. Dropping these lines down from the first cross-arm to the second perpendicular cross-arm uses up considerable vertical space on the extension bayonet. As a result, it is not possible to carry transformers or other heavy equipment at these corner run locations as this heavy equipment would also require considerable vertical space on the extension bayonet. Existing extension bayonets simply do not have the sufficient vertical space or strength to support both heavy equipment and two perpendicular cross-arms.

3. Objects of the Invention

The main object of the present invention is to provide an apparatus for connecting a pole top extension to the top end of a cylindrical wooden utility pole which will provide a high strength pole extension capable of being guyed and loaded with heavy equipment, such as a transformer.

It is a further object of the invention to provide a wooden pole top extension such that, when a pole top has become sufficiently weathered or decomposed, replacement can be made of this top section of the wooden utility pole without the need for replacement of the entire wooden utility pole.

Another object of the present invention is to provide a pole top extension to which cross-arms can be more easily mounted in the proper aligned orientation particularly in corner runs where the direction of travel of the lines changes, typically by 90°. Specifically, it is an object of the present invention to provide a pole top extension to which parallel cross-arms can be mounted at the same height, without using up significant vertical height on the extension bayonet.

Another object of the invention is to provide a pole top extension that can be guyed from any one or all four sides.

Another object of the present invention is to provide a pole top extension which is more easily installed by allowing for the assembly of all cross-arms, transformers and guying hardware onto the extension bayonet while the bayonet is on the ground. This then enables the resulting unit to be raised as a whole for attachment onto a position on top of the wooden utility pole.

Another object of the invention is to provide a pole top extension wherein one or more cross-arms can be securely mounted such that they will not wobble excessively under heavy wind loads, with the cross-arms readily mounted either parallel or perpendicular to one another when a plurality of cross-arms is mounted to one pole top extension.

Another object of the invention is to provide a pole top extension wherein the collar connecting the extension bayonet to the assembly has a sufficient height to width ratio such-that it extends far enough to cover a sufficient length of the bottom of the extension bayonet such that the connection produced is able to withstand considerable bending stresses.

It is another object of the invention to provide a pole top extension that can be mounted onto the flattened top of a wooden utility pole, without requiring first for the removal of any existing cross-arms already mounted to said utility pole.

An additional object of the invention is to provide a pole top extension which, during installation, does not require first orienting an assembly mounted on top of a wooden utility pole followed by secondly orienting the direction of an extension bayonet.

The apparatus and method of the present invention has other objects and features of advantage which will become apparent from and are set forth in more detail in the Description of the Best Mode of Carrying Out the Invention and the accompanying drawing.

DISCLOSURE OF THE INVENTION

The present invention provides an assembly for mounting a pole top extension bayonet to the circular cross-section of the flattened top end of a cylindrical wooden utility pole. This assembly is comprised of a pair of bracket members each having a leg portion. These leg portions extend circumferentially partially around a side of the pole and extend down the sides of the pole. The leg portions are connected together and to the existing pole by a series of fasteners which extend through the center of the pole, securing the bracket members on opposite sides of the pole. The bracket members each have transversely extending upper portions which are formed to matingly interengage together over the top of the pole.

At least one of the bracket members has a rectangular collar opening upwardly to receive the lower end of the wooden extension bayonet. This rectangular collar has two pairs of opposite side walls which are oriented, respectively, substantially parallel and perpendicular to the leg portions. This rectangular collar preferably is square such that its strength of attachment preferably is the same in either of two perpendicular directions and the same alignment of the extension bayonet in any particular direction can be achieved for two possible perpendicular mounting positions of the pole top assembly. The bottom end of a wooden extension bayonet is slidably received into this collar and fastened to the collar by at least one fastener which extends transversely through the collar and through the extension bayonet itself. The extension bayonet can be a natural wood, a laminated wood, or a parallam wood product, which can be treated with penta as per specification AWPA-C28-91 or with C.C.A. (copper chromate), as applicable for the type of wood product used. Since the two bracket members can be attached to any two opposing sides of the wooden utility pole, the rectangular shaped extension bayonet can be faced in any direction. In a preferred embodiment, the leg portions have a U-shaped cross-section which helps to engage the opposite sides of the wooden utility pole. In this embodiment, the upper portions of the bracket assembly are mounted in a telescoped interengagement. Also in a preferred embodiment, the interengaging upper portions of the bracket assembly form a pair of box-like channels, dimensioned such that one is slidably received into the other.

A spacer member also may optionally be mounted in a position between one leg portion and the pole such that the bracket assembly is adapted for mounting on utility poles of smaller diameter. This spacer member is formed to engage and bear against the pole in a stable position, and it has at least one fastener receiving opening adapted to receive the fastener used to couple the bracket members to the pole. In a preferred embodiment, this spacer member is formed to have a U-shaped cross-section.

BEST MODE OF CARRYING OUT THE INVENTION

The utility pole extension assembly of the present invention provides an apparatus which allows existing utility poles to be used notwithstanding pole top rot or the need to make substantial line reconfigurations. Even preservative-treated pole tops can start to rot or break down structurally. Prior art methods necessitated the replacement of these polls. The present invention overcomes this problem as only the rotted top section need now be replaced. The result is the potential for substantial savings in the use of new pole timbers. Moreover, the present pole top extension assembly has sufficient strength and durability that it can support heavy equipment and can be used with asymmetric guying, making the number of applications in which it can be used even greater.

Figure 1:
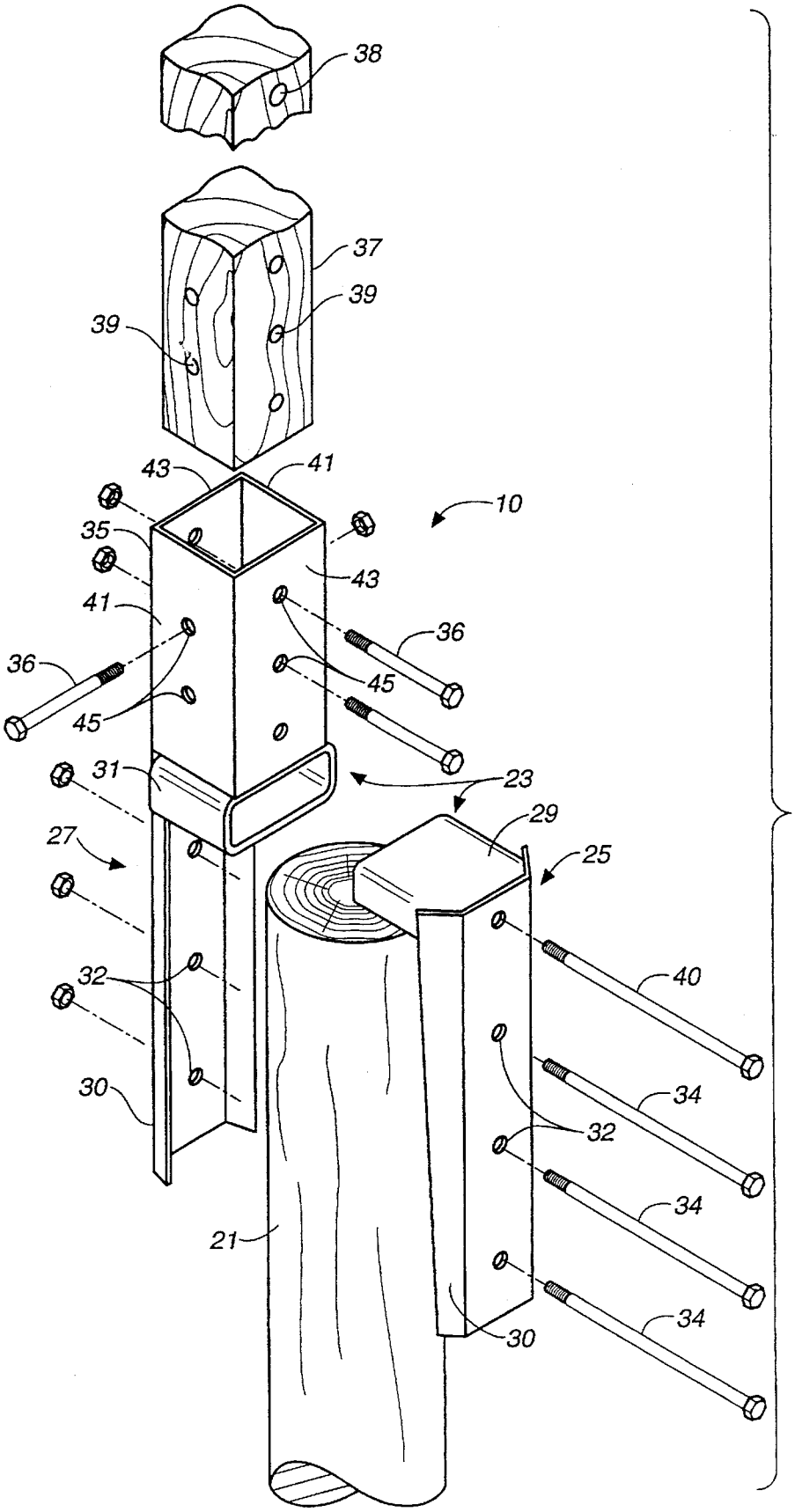
FIG. 1 is an exploded perspective view of a pole top extension assembly constructed in accordance with the present invention, with the optional spacer member omitted.

Referring now to FIG. 1 a pole top extension 10 constructed in accordance with the present invention is shown which is mounted to the top of a wooden utility pole 21 to add length to the top end of pole 21. Pole top extension 10 can be used for mounting existing wires at a greater height, when needs or code requirements change, or as a replacement for the rotted top section of the utility pole. In either case, extension assembly 10 eliminates the need to replace the entire pole. When assembled, the resulting pole top extension 10 provides a solid structure in which the lower end of a wooden bayonet extension 37 is anchored to the upper end of a wooden utility pole 21.

Pole top extension 10 is comprised of a bracket assembly, generally designated 23, and a rectangular wooden extension bayonet 37. Bracket assembly 23, includes a pair of U-shaped bracket members 25 and 27 each having a leg portion 30 which extends circumferentially partially around the side of the pole to hold the assembly in place at the top end of the utility pole 21. Each leg portion 30 engages the top end of pole 21 at circumferentially spaced intervals to stabilize the assembly on poles of somewhat differing diameter, and leg portions 25 and 27 are formed to extend downwardly from the top of the pole by a distance sufficient for securement of each leg portion 30 to the opposing sides of the pole by at least one fastener. Preferably, a plurality of holes 32 on opposing bracket members 25 and 27, are provided so that they can be aligned for receipt of a plurality of lag bolts 34 which extend through the pole and couple leg portions 30 together.

At the top of bracket member 25 is formed a transversely extending upper portion 29. Bracket member 27 similarly is formed a corresponding transverse upper bracket portion 31. Upper portions 29 and 31 of the bracket members extend transversely over the top of wooden utility pole 21 and matingly interengage with each other. In the preferred form, upper portions 29 and 31 have a box-like or rectangular channel configuration and are formed to telescopically slide one inside the other. Aligned openings 33 allow a lag bolt 36 to be passed through the center of the telescoped channels 29 and 31. Upper bracket portions 29 and 31, therefore, may be coupled together when placed over the top of poles 21 of varying diameter, and the brackets 25 and 27 rest on the top flattened end of pole 21. Also shown is lag bolt 40 which passes through the center of the rectangular channels to secure the same together in telescopic relation.

In order to receive and support a pole extension member, one of the bracket members, in this case bracket member 27, has a collar assembly, generally designated 35. Collar assembly 35 opens upwardly to receive the lower end of an extension bayonet 37 therein. As thus far described, bracket assembly 10 has a structure which is essentially the same as has been employed in the prior art to secure cylindrical, tubular, fiberglass pole top extensions to utility poles. In the pole top extension assembly of the present invention, however, collar 35 and extension bayonet 37 have been significantly improved.

In order to provide greater strength, durability and alignment stability, collar 35 of the present pole top extension assembly is formed as a rectangular collar, and bayonet 37 is formed as a wooden member having a rectangular cross-section substantially mating with, and slidably received in, collar 35. Rectangular collar 35 is defined by two pairs of opposite sidewalls 41 and 43 which are oriented substantially perpendicular and substantially parallel to leg portion 30 of bracket member 27, respectively. Sidewall pair 41 and sidewall pair 43 each have a plurality of aligned holes 45 through which lag bolts 36 extend to attach wooden extension bayonet 37 to collar assembly 35.

Additionally, and very importantly, collar 35 of the present pole top extension assembly has a height dimension which is significantly greater than that used for fiberglass extensions. Preferably, this rectangular collar 35 will be in the shape of a square such that its strength will be the same in either of two perpendicular directions. In addition, this square shape of the extension bayonet will enable the leg portions to be attached to one of two perpendicular orientations at the top of the utility pole. This allows for flexibility in the positioning of the pair of leg portions 30 of bracket member 27, such that the leg portions 30 may be mounted so as not to interfere with existing hardware mounted near the pole top.

As will be seen, a plurality of vertically spaced, fastener-receiving openings 45 are provided in mutual sides 41 and 43 of the collar. The collar height is preferably at least about two times the width dimension of the collar so as to extend a substantial distance up extension bayonet 37. Conventional fiberglass collars have a height less than the collar diameter and are designed to receive a single transverse lag bolt therethrough.

The substantial height of the present collar is particularly helpful in resisting the substantial moments induced by hanging heavy equipment on a side of extension bayonet 37. Thus, a transformer, which can weigh, for example, 1000 pounds, or more, can be mounted to any side of bayonet 31 and as many as five lag bolts 36 used to couple the bayonet to collar 35. The combination of a solid, wooden bayonet, a plurality of lag bolts, and a high rectangular collar, produces a very stable high strength pole top extension which has a greatly increased number of possible applications in the utility industry. The present invention has been tested to hold 2500 pounds cantilevered at 18 inches from the extension bayonet without failure.

As extension bayonet 37 is a solid wooden member and not a hollow fiberglass tube, extension bayonet 37 is, itself, of a much higher strength than previous bayonets. Prior art fiberglass extensions often are only rated to support a cross-arm and wires, and they cannot be asymmetrically guyed or used to carry heavy equipment. Conversely, the use of a solid wooden extension bayonet 37, being much stronger, enables asymmetric guying any side of pole 21. The need for guying is specifically important when the utility pole stands at a corner run location in a utility line. At corner run positions, where the line direction changes substantially, (typically by about 90°), a transverse moment is present which tends to topple the pole. As the present wooden extension bayonet 37 is of high strength and its coupling to pole 21 is capable of withstanding substantial moments, guy wires may be attached to it from a side opposite the corner run moment.

In an additionally important aspect of the use of a solid, wooden bayonet is that field assembly is much easier, as compared to fiberglass extensions. Pole top extension assembly 10 allows on the ground assembly of components and mounting of cross-arms and transformers. Thus, bracket member 27 can be attached easily to bayonet 37 using conventional tools, such as, a hand drill and wrenches. It is easy to drill holes into an extension bayonet that is made of wood, whereas clean, fracture-free holes in fiberglass usually require a carbide drill. Moreover, the drilled holes in the present wooden extension bayonet 37 do not tend to significantly weaken the structure, as can be the case when drilling into a fiberglass tube.

In addition, the attachment of all cross-arms, transformers and guying wires onto the extension bayonet can be performed while the unit is still on the ground. Later, the assembly, including bracket 25, can be raised into a position on top of wooden utility pole 21. Consequently, assembly of pole top extension 10 does not first require adding a bracket assembly to the top of an existing utility pole, and then subsequently adding an extension bayonet to the assembled bracket.

In order to support heavy loads, extension bayonet 37 rests directly on the interengaged bracket portions 29 and 31, which in turn rest directly on the flattened top end of wooden utility pole 21. In this arrangement, the weight of the extension bayonet 37 and anything attached to it is supported directly by the top flattened end of the utility pole 21 rather than just by a fastener. This represents a significant improvement over prior art fiberglass extension systems in which the extension bayonet is bolted to the collar in a raised position, thus having the entire weight of the assembly held by one lag bolt. The present wooden extension bayonet 37 is pre-assembled with collar 35. Bolt holes are drilled in the field to receive lag bolts at various heights for the mounting of cross-arms and/or other heavy equipment. The bayonet assembly 37 also has a plurality of holes 39, pre-drilled near its lower end to receive lag bolts 36 such that extension bayonet 37 is held firmly in place in collar 35. Typically, at this lower end, three holes are drilled through the extension bayonet in one direction and two holes are drilled through the lower end of the extension bayonet in a perpendicular direction. These three corresponding lag bolts pass through sidewalls 43 of collar 35 and two corresponding lag bolts pass through sidewalls 41 of collar 35 securing the extension bayonet 37 to the collar 35. At the top end of bayonet extension 39, a hole 38 is drilled to allow for insertion of a hoisting pin which is used for installation using a crane and sling.

Figure 2:
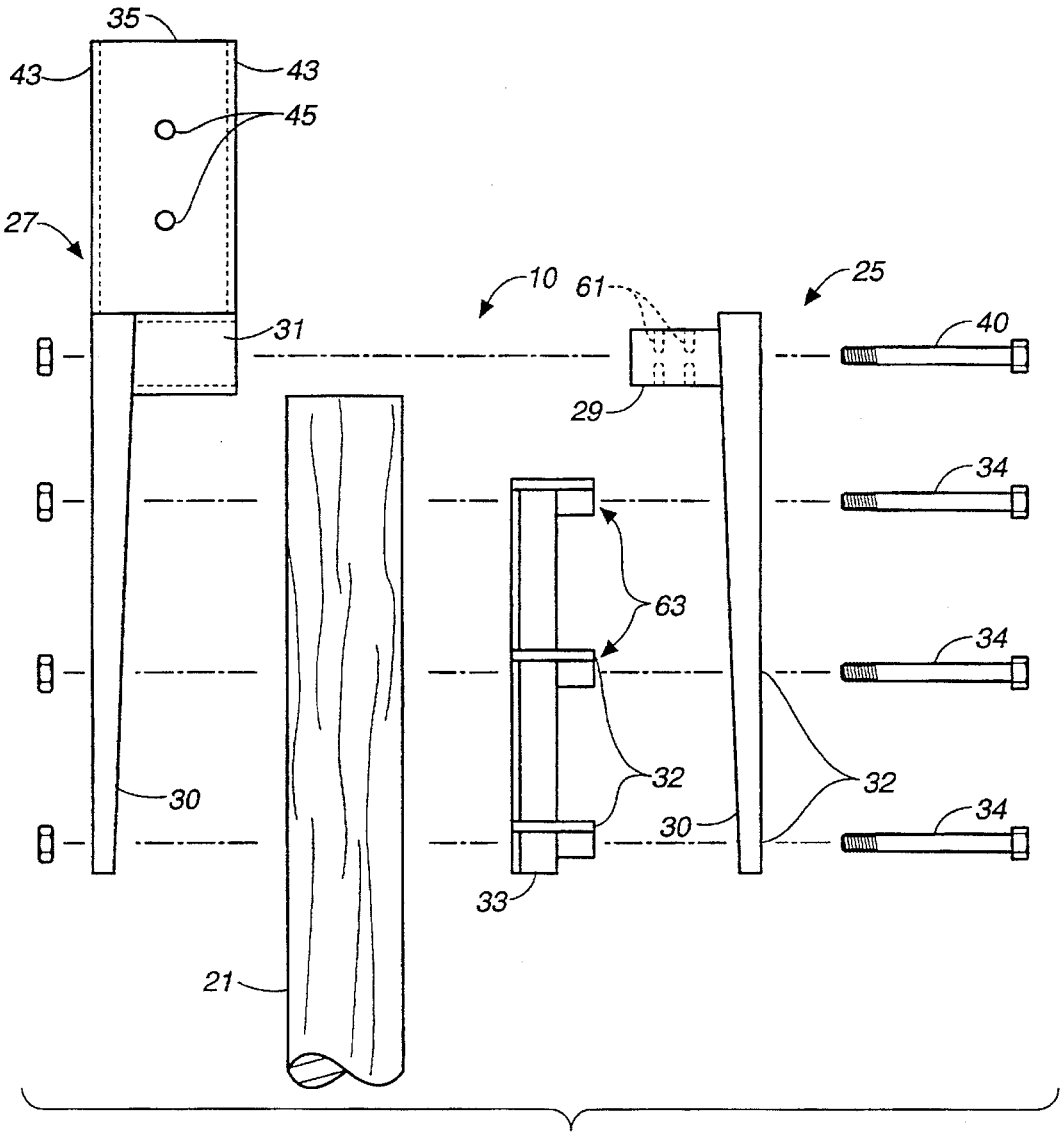
FIG. 2 is an exploded, side elevational view of the present apparatus, showing the detail of the invention, with the optional spacer member included.
Figure 4:
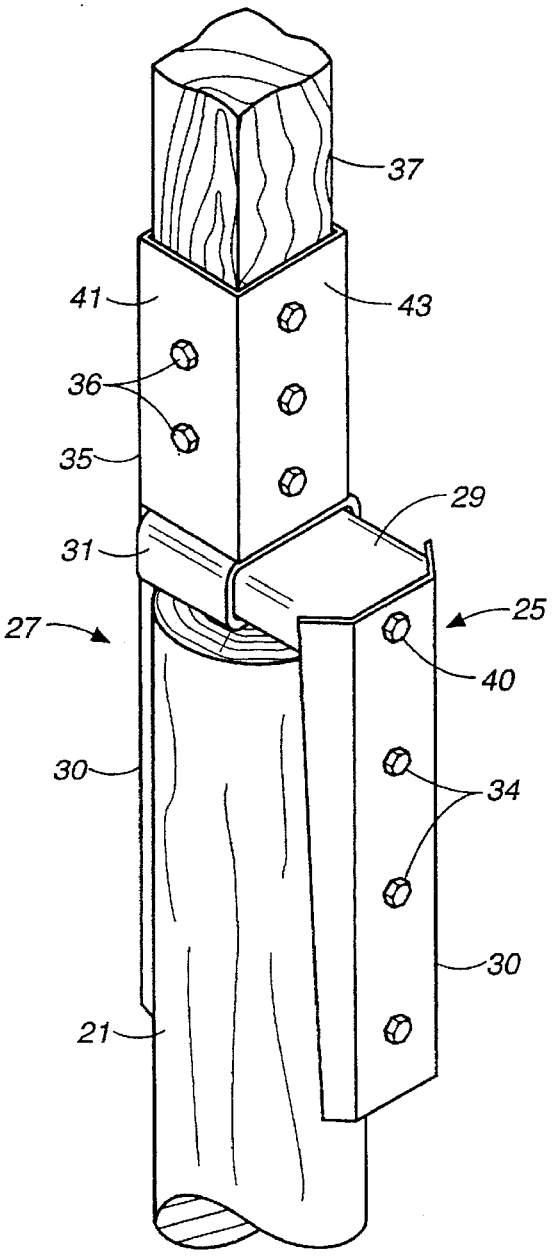
FIG. 4 is a perspective view of the present apparatus, with the optional spacer member omitted.
Figure 6:
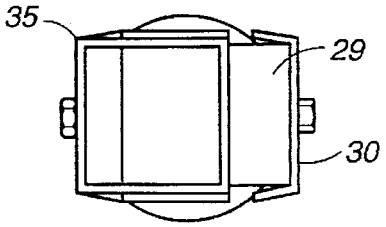
FIG. 6 is a top plan view of the present apparatus, with the optional spacer member omitted.

FIG. 2 shows a pole top extension assembly 10 positioned for mounting at the upper end of a wooden utility pole 21. Leg portions 30 have a plurality of transverse holes 32 through which a plurality of lag bolts 34 are passed. Lag bolts 34, when passed through utility pole 21 and tightened into place, couple bracket members 25 and 27 together around the pole. The matingly interengaging upper bracket portions 29 and 31 are also shown and a lag bolt 40 passes through the center of the rectangular channels to secure the same together in telescopic relation. In order to provide stiffening of the collar area of the bracket assembly, the inner box-shaped channel portion 29 preferably is formed with transversely extending webs 61 having central aligned openings therein to receive lag bolt 40 therethrough. FIG. 4 illustrates a perspective view of the pole top extension when fully assembled in position between the wooden utility pole 21 and the wooden extension bracket 37. FIG. 6 shows a top plan view of the apparatus as assembled in FIG. 4.

An optional spacer member 33 may be provided which is to be inserted between the sliding bracket member leg portion 30 of bracket 27, and wooden utility pole 21. This spacer member 33 is used to enable securement of bracket members 25 and 27 to smaller diameter utility poles 21. The spacer allows brackets 25 and 27 to be coupled tightly against the smaller pole when lag bolts 34 pass through spacer member 33. Spacer member 33 has stiffening flanges 63 with holes 32 which are positioned to line up with holes 32 in bracket member 27, thus allowing lag bolt 34 to pass through spacer member 33 and support the same with bracket member 27. This allows the mating of upper portions 29 and 31 to occur while ensuring that bracket member 27, through its contact with spacer member 33, can be fastened by lag bolts 34 to tightly urge the spacer against the surface of wooden utility pole 21 on one side while bracket 25 engages the other side of the pole.

Figure 3:
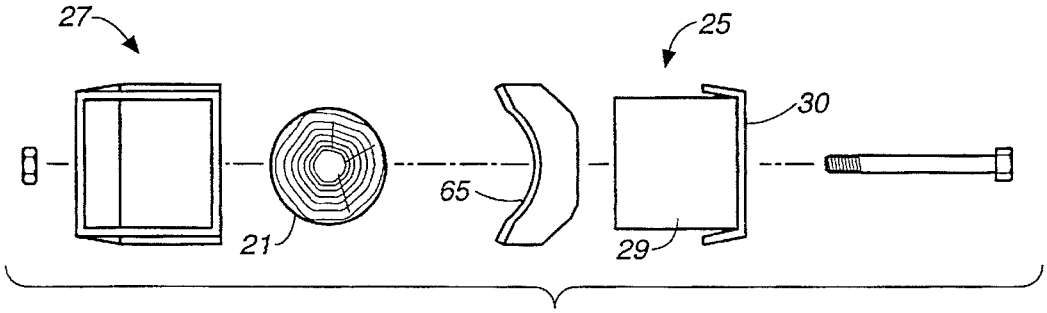
FIG. 3 is an exploded plan view of the present apparatus, showing the detail of the invention with the optional spacer member included.
Figure 5:
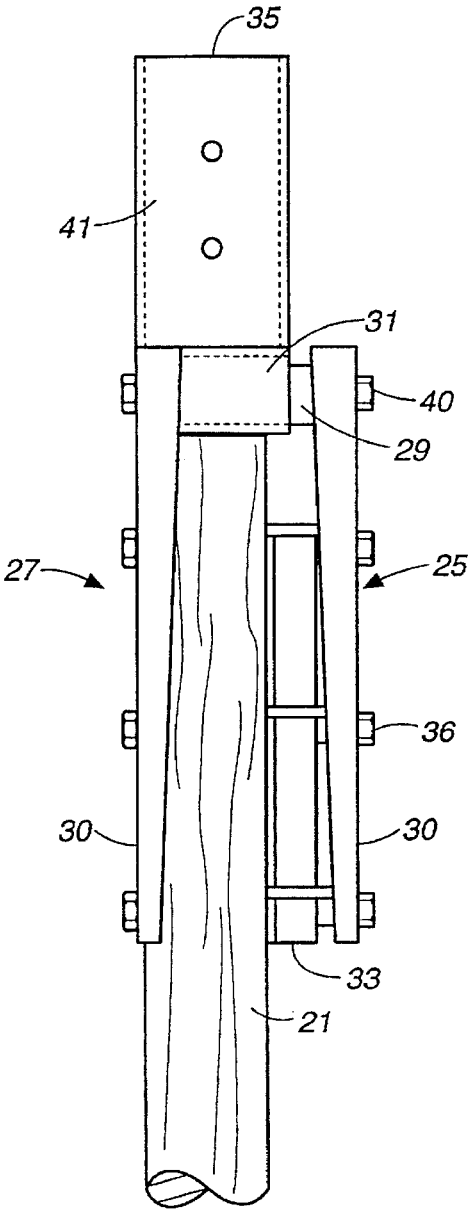
FIG. 5 is a side elevational view of the present apparatus, with the optional spacer member included.
Figure 7:
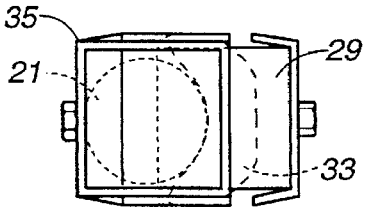
FIG. 7 is a top plan view of the present apparatus, with the optional spacer member included.

The curved surface 65 of optional spacer member 33, as is best shown in the exploded plan view of FIG. 3, is adapted to mate with the curved outer surface of utility pole 21 such that pole top extension 10 fastens tightly and snugly into position and will not move about on utility poles of smaller diameter. FIG. 5 illustrates a side elevational view of the assembled pole top extension fastened to a small diameter pole 31 with the spacer member 33 included. FIG. 7 shows a top plan view of the apparatus as assembled in FIG. 5 with the spacer member 33 and utility pole 21 shown in dotted lines such that their mating surfaces are clearly revealed.

Figure 8:
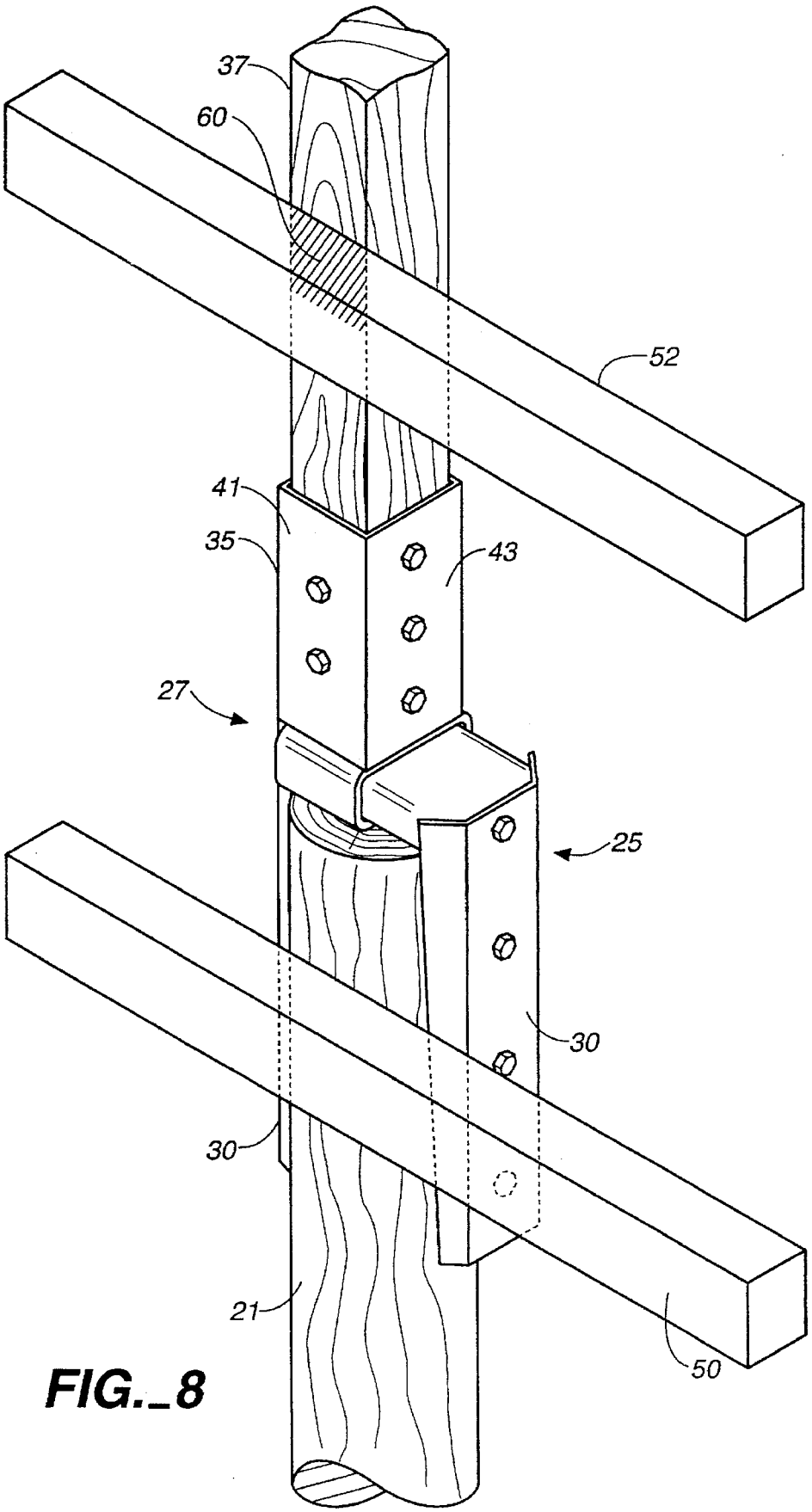
FIG. 8 is a perspective view of the present apparatus with the optional spacer member omitted, and a pair of parallel wooden cross-arms mounted with one on each of the wooden utility pole and the wooden extension bayonet.

FIG. 8 shows a horizontal cross-arm 50 mounted to the wooden utility pole 21 and a cross-arm 52 mounted to extension bayonet 37. The present design is specifically suited to connect a wooden extension bayonet 37 of rectangular cross-section to a wooden utility pole 21 of circular cross-section. In addition to the strength advantages which accrue from the use of a solid wooden member, this rectangular cross-sectional of the wooden extension bayonet 37 affords a number of structural advances not seen in the prior art. The orientation of sidewalls 41 and 43 of collar assembly 35, being substantially perpendicular and parallel to the leg portion 30 of bracket members 25 ad 27, ensures that cross-arm 52 can easily be aligned into substantially parallel orientation with cross-arm 50. Typically, cross-arm 50 will have been mounted in its position for a long time before the addition of pole top extension 10. Leg portions 30 of bracket members 25 and 27 will fit easily into position behind cross-member 50. In this way, pole top extension 10 can be mounted to the top end of wooden utility pole 21 without removal of existing cross-arm 50. When the leg portions 30 are fastened to the top of utility pole 21, they are easily positionable so as not to interfere with cross-arm 50. This positioning of both leg portions 30 ensures that collar 35 is oriented such that a flat side of extension bayonet 37 is oriented to receive cross-arm 52 in a substantially parallel relationship to cross-arm 50. But if desired, cross-arm 52 can instead easily be rotated by 90° and mounted substantially perpendicularly to cross-arm 50. An advantage of being able to mount leg portions 30 without having to remove cross-arm 50 is that cross-arm 50 may remain in position both during the attachment of extension bayonet 37, and afterwards. As such, cross-arm 50 may remain attached for use as an additional cross-arm after the attachment of the extension bayonet 37 and cross-arm 52.

Another advantage of extension bayonet 37 having a rectangular cross-section is stability for cross-arms attached thereto. Cross-arm 52 can easily be mounted onto the flat sides of the extension bayonet 37. Fastening this cross-arm 52 having a rectangular transverse cross-section onto a flat side of the extension bayonet 37 results in a large planar contact area 60, affording much greater stability than could be obtained with rectangular cross-arms being attached to the sides of prior art cylindrically-shaped extension bayonets. In the prior art, rectangular cross-section cross-arms were bolted to the sides of cylindrical fiberglass extension bayonets, and heavy wind loading can cause the cross-arms to wobble about the line contact with the fiberglass extension bayonet if a backing plate is not used. However, even this can cause a problem if the mounting bolts are over-tightened to cause the fiberglass tube to distort. This rapidly loosens the connection to the cross-arm and can result in break-down of the extension. In the present pole top extension assembly, the large planar bearing area 60 ensures a high strength coupling of the cross-arm, or a transformer, to the post and reduces the likelihood of wind-induced wobbling and failures.

Figure 9:
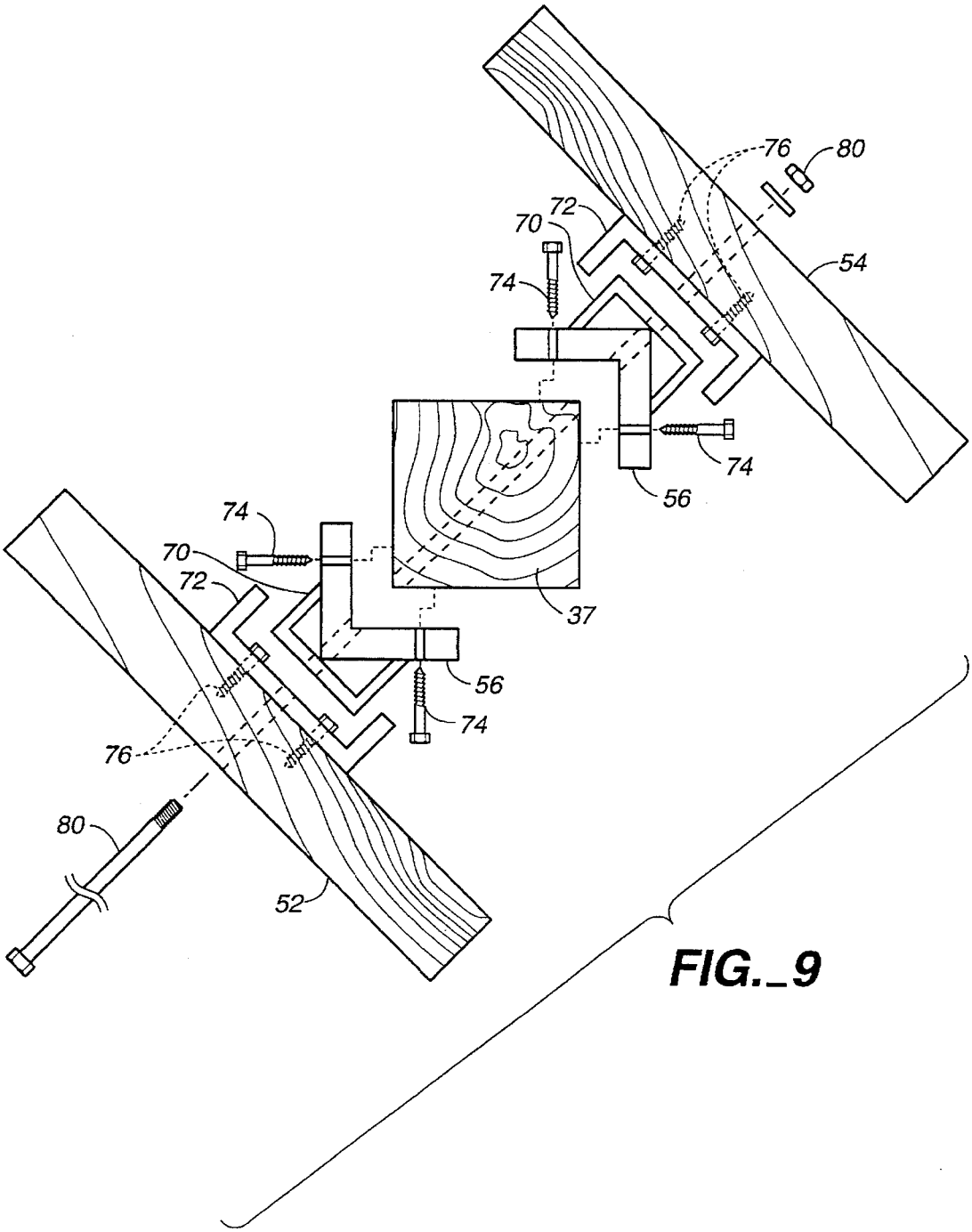
FIG. 9 is an exploded top plan view of the extension bayonet of the present apparatus, with a pair of parallel wooden cross-arms mounted at the same vertical height on the wooden extension bayonet.
Figure 10:
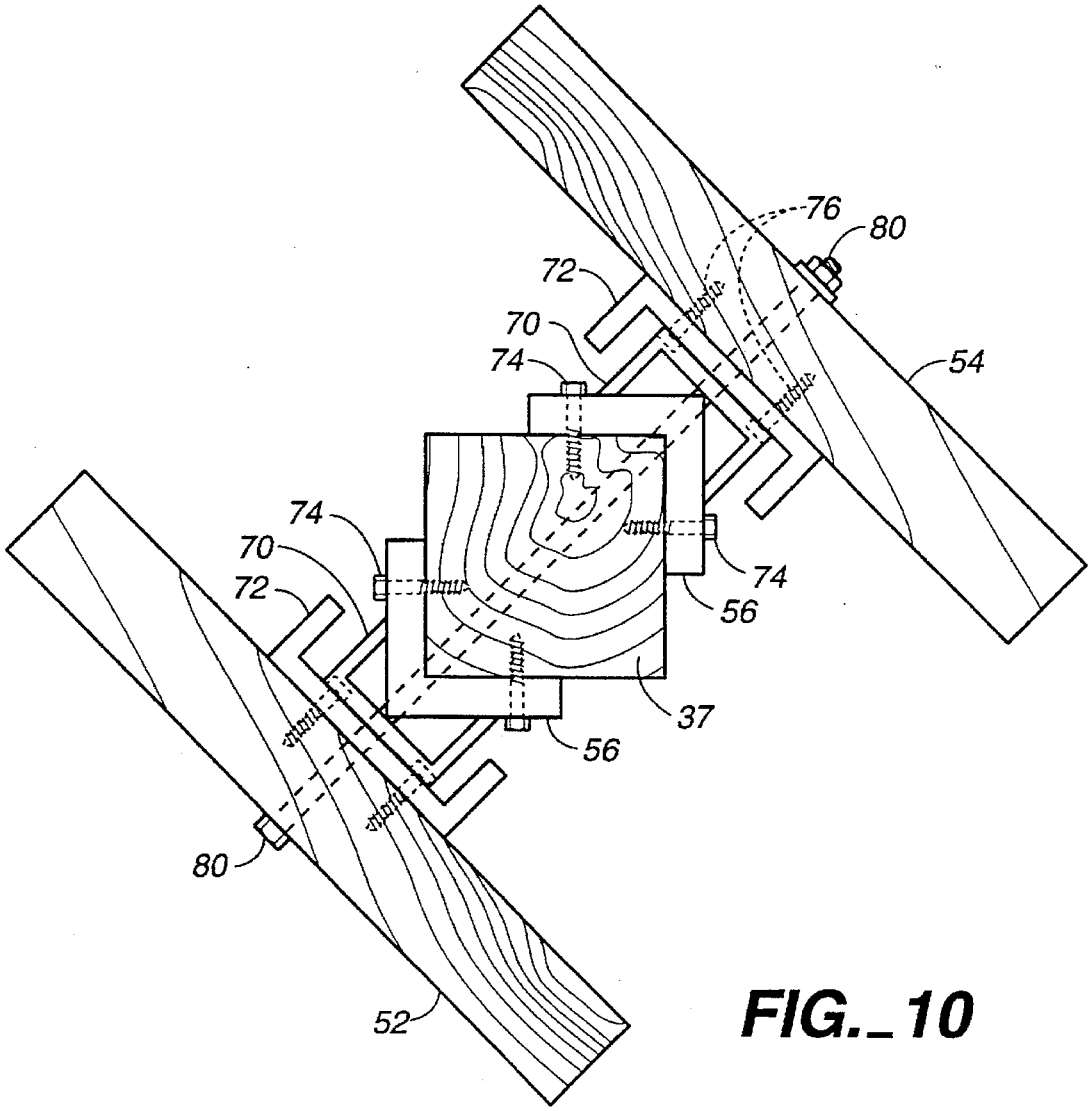
FIG. 10 is a top plan view of the extension bayonet of the present apparatus, with a pair of parallel wooden cross-arms mounted at the same vertical height on the wooden extension bayonet.

At corner run locations, two parallel cross-members are attached to the wooden extension bayonet at the same vertical height. As is best shown in FIG. 9 and 10, which illustrate a top view of such a corner run location, two cross-arms 52 and 54 are used. These cross-arms are parallel to one another, and are mounted at the same height on extension bayonet 37, rather than being vertically staggered, as was required in corner end runs using prior art fiberglass extension bayonets. In these prior art systems, the vertically spaced-apart cross-arms were mounted perpendicular to one another. Accordingly, in these systems, the cables or power lines were received onto the ends of one cross-arm, then dropped to the ends of the perpendicular cross-arm from which these cables or power lines then proceeded away in a new direction which was perpendicular to the direction from which the cables first arrived onto the first cross-arm.

At a corner end run in the present invention, the cables or power lines are received onto the ends of a first cross-member 52, at an angle approximately 45° from the transverse length of the cross-arm. From here, these cables or power lines are then connected to the ends of the other wooden cross-arm 54, from which the lines proceed away in a direction of travel 45° to the transverse length of the cross-arm which is also perpendicular to the direction from which they first arrived onto the first cross-arm 52. In this way, the present invention is able to support power lines or cables at a corner end run where the direction of travel of the lines changes by 90°, (45 using one cross-arm and 90 using two parallel cross arms), overcoming the prior art limitation which had used up considerable vertical height on the extension bayonet at these corner run locations as the cross-arms were placed perpendicular to one another at different heights. Therefore, the present invention reserves needed vertical height on the extension bayonet which can be used for the mounting of transformers or other bulky equipment and can avoid perpendicular cross-arms entirely if needed.

The 45° mounting angle between the parallel cross-arms 52, 54 and the sides of extension bayonet 37 is shown in FIG. 9 and 10 and is achieved as follows. Mounting brackets 56 are secured into the perpendicular sides of bayonet 37. To these mounting brackets 56 are welded C-shaped mounts 70. These C-shaped mounts are received into channel members 72 which are connected to cross-arms 52 and 54 by lag bolts 76. The channel members 72 and mounts 70 fasten together by a lag bolt 80 which passes through the pair of mounts 70, the pair of channel members 72, the extension bayonet 37, and the pair of cross-arms 52 and 54, securing the cross-arms firmly into parallel positions on opposite sides of the extension bayonet. These mounting brackets 56 can be secured in the field at any height on the bayonet extension using a hand drill and lag bolts 74 ensuring highly secure connection between arms 52, 54, mounts 70, channel members 72 and extension bayonet 37 such that the cross-arms are rigidly held at 45° to the bayonet side surfaces. Mounting brackets 56 can be installed while the extension bayonet 37 is installed, or they can be installed on the ground prior to installing the pole top extension 10. The result being a simple and effective way of ensuring that one or more cross-arms can easily be mounted at a 45° angle to the extension bayonet. Using the present device and method, it is also possible to mount the cross-arms of a pole top extension at 45° to an existing cross-arm already mounted on the wooden utility pole, without having to remove the existing cross-arm, should this be desired.

What is claimed is:

1. A pole top extension assembly mounting to a top of a cylindrical wooden utility pole comprising:

a) a bracket assembly including a pair of bracket members each having a leg portion adapted to extend circumferentially partially around a side of the pole and formed to extend downwardly from the top of the pole by a distance sufficient for securement of each leg portion to opposite sides of the pole using a plurality of transversely extending fasteners extending through the pole and coupled between the leg portions, each said bracket member further having a transversely extending upper portion formed to matingly interengage with the other upper portion for coupling of the upper portions of said bracket members together over the top of the pole, and at least one of the bracket members including a rectangular collar opening upwardly to receive a bayonet member therein, said rectangular collar having a first and second pair of opposite side walls, said first pair of opposite side walls oriented substantially parallel to said leg portions and said second pair of side walls being oriented substantially perpendicular to said leg portions; and b) a solid wooden bayonet having a rectangular transverse cross-section substantially mating with said collar, said bayonet being slidably received inside said collar with a first pair of sides thereof oriented substantially parallel to said leg portions, a second pair of sides thereof oriented substantially perpendicular to said leg portions, and a bottom of the bayonet supported on an upper portion of a leg portion; and c) at least one fastener extending transversely through said collar and said wooden bayonet and coupling said wooden bayonet to said collar.

2. The pole top extension assembly as defined in claim 1 wherein, said bayonet is provided by one of a laminated wooden post and a natural lumber post.

3. The pole top extension assembly as defined in claim 2 wherein, both of said upper portions are provided by box-like channels and one of said box-like channels has an open end and is dimensioned to slidably receive the remainder of said box-like channels, said remainder of said box-like channels having a plurality of transverse stiffening webs extending thereacross, and said leg portions and said stiffening webs having aligned fastener-receiving openings therein, and at least one fastener mounted through said openings to couple said upper portions together.

4. The pole top extension as defined in claim 2 wherein, said bayonet is a laminated wooden member pressure-treated with a wood preservative.

5. The pole extension as defined in claim 1 wherein, said collar has a height dimension at least about two times a widest width dimension to permit a plurality of vertically spaced fasteners to pass therethrough on each pair of side walls.

6. The pole top extension assembly as defined in claim 1 wherein, said rectangular collar is a square collar.

7. A pole top extension assembly for mounting to a top of a cylindrical wooden utility pole comprising:

a) a bracket assembly including a pair of bracket members each having a leg portion adapted to extend circumferentially partially around a side of the pole and formed to extend downwardly from the top of the pole by a distance sufficient for securement of each leg portion to opposite sides of the pole using a plurality of transversely extending fasteners extending through the pole and coupled between the leg portions, each said bracket member further having a transversely extending upper portion formed to matingly interengage with the other upper portion for coupling of the upper portions of said bracket members together over the top of the pole, and at least one of the bracket members including a collar opening upwardly to receive a bayonet member therein;

b) a bayonet having a transverse cross-section substantially mating with said collar, said bayonet being slidably received in said collar;

c) at least one fastener extending transversely through said collar and said bayonet and coupling said bayonet to said collar; and at least one spacer member formed to extend longitudinally down one of said leg portions in a position between the leg portion and the pole, said spacer member being formed to mate with an inwardly facing surface of the leg portion and formed to engage and bear against the pole in a stable position, and said spacer having a fastener receiving opening therethrough adapted to receive a fastener used to couple the bracket members to the pole.

8. The pole top extension as defined in claim 7 wherein, said spacer member is formed with a V-shaped cross-section with a plurality of transversely oriented strengthening webs.

* * * * *